US006309046B1

(12) United States Patent
Izawa et al.

(10) Patent No.: US 6,309,046 B1
(45) Date of Patent: Oct. 30, 2001

(54) MULTIPLE-HEAD INK JET PRINTER

(75) Inventors: Hideo Izawa; Yasushi Katagiri, both of Chiba (JP)

(73) Assignee: Miyakoshi Printing Machinery Co., Ltd., Chiba (JP)

( * ) Notice: Subject to any disclaimer, the term of this patent is extended or adjusted under 35 U.S.C. 154(b) by 0 days.

(21) Appl. No.: 09/429,169

(22) Filed: Oct. 28, 1999

(30) Foreign Application Priority Data

Nov. 6, 1998 (JP) ..... 10-315554

(51) Int. Cl.[7] ..... B41J 2/145; B41J 2/15; B41J 2/01

(52) U.S. Cl. ..... 347/40; 347/105

(58) Field of Search ..... 347/104, 40, 154, 347/105; 346/136, 139

(56) References Cited

U.S. PATENT DOCUMENTS 5,828,814 * 10/1998 Cyman et al. ..... 358/1.2

5,906,156 * 3/1999 Shibuya et al. ..... 101/93.12

FOREIGN PATENT DOCUMENTS 5-124284 5/1993 (JP) .
6-199457 7/1994 (JP) .

* cited by examiner

*Primary Examiner*—Thinh Nguyen
(74) *Attorney, Agent, or Firm*—Wenderoth, Lind & Ponack, L.L.P.

(57) ABSTRACT

An ink jet printer of the type having a plurality or multiplicity of ink jet heads for printing as many characters on a continuous strip of paper or the like traveling between a pair of guide rollers or the like. In order to prevent the strip from fluttering while traveling the elongate distance between the pair of guide rollers, one or more intermediate guide rollers are provided therebetween, in positions offset from a plane tangent to both guide rollers toward one side of the plane opposite to the side where the guide rollers are located. At least two ink jet heads may be provided between every two neighboring pair of guide and intermediate guide rollers.

12 Claims, 2 Drawing Sheets

MULTIPLE-HEAD INK JET PRINTER

BACKGROUND OF THE INVENTION

This invention relates to ink jet printers and particularly to those having a plurality or multiplicity of ink jet heads in alignment for printing as many characters or symbols on a continuous strip of paper or like printable material traveling along a predefined path.

One of the essentials for production of high quality printings by ink jet printers of the kind under consideration is that there be an unvarying spacing between the series of ink jet heads and the surface of the strip of paper to be printed. Typical of contrivances heretofore made to attain this objective are those described and claimed by Japanese Unexamined Patents Publication Nos. 5-124284 and 6-199457. They are alike in teaching a single ink jet head or pen printer wherein a continuous web or individual sheets of paper or the like are printed upon while traveling on a fixed, flat platen, by which is held constant the spacing between head and paper.

The fixed flat platen has proved unsatisfactory, however, when incorporated in multiple head ink jet printers in which a multiplicity of ink jet heads are aligned along a predefined path of a continuous strip of paper or like printable material for printing as many characters or symbols thereon. Consider an elongate flat platen mounted opposite to the series of ink jet heads, and with the paper strip fed over the platen by guide rollers or pairs of feed rollers disposed adjacent to both ends of the platen. The paper strip has been very easy to flutter over the platen by reason of the inconveniently long distance between the guide rollers or the like, thereby giving rise to variations in the spacing between the paper strips surface and the heads.

Such inconveniences have become even more pronounced in printers using an aqueous ink. Almost unavoidably stretched out, slackened, or creased by the ink moisture, the paper strip has often failed to travel at a desired constant distance from the ink jet heads, no matter how much it is tensioned as by increased feeding force or braking.

The Japanese unexamined patent publications cited above employ means in addition to the flat platen for holding the paper against it. However, such means are effective only in single-head printers, not applicable to multiple head devices where the paper must travel stably a much longer distance past a row or rows of multiple heads.

SUMMARY OF THE INVENTION

It is an object of this invention to keep the strip, ribbon or web of paper or like printable material from fluttering while traveling any elongate distance past a row or rows of multiple heads in ink jet printers of the kind defined.

Another object of the present invention is to minimize the noted adverse side effects of use of an aqueous ink in attaining the first recited object.

Still another object of the present invention is to accomplish the foregoing objects by use of practically the simplest possible means that can be readily incorporated in multiple head ink jet printers of various known general constructions.

Summarized in brief, the present invention provides a multiple-head ink jet printer for printing on a continuous strip of paper or like printable material, comprising a pair of guide means spaced from each other for guiding a continuous strip of printable material through a printing station within the printer, at least one intermediate guide member disposed intermediately between the pair of guide means for providing therebetween a guide path having a bend in it along which the strip of printable material is to travel through the printing station, and a plurality of ink jet heads positioned for printing on the strip of printable material traveling between one of the guide means and the intermediate guide member and between the intermediate guide member and the other of the guide means.

In the practice of this invention the pair of guide means may take the form of guide rollers, although such means may perform the additional function of feeding the strip. The intermediate guide member may then be in the form of a roller, disposed intermediately between the pair of guide rollers and offset from a plane tangent to both guide rollers, preferably toward that side of the plane which is opposite to the side where the guide rollers lie.

There is thus provided a V-shaped guide path, having a bend, preferably obtuse-angled, in it. The strip may travel along such a bent path under greater tension than along the conventional straight path. The guide path according to the instant invention may be restated as a succession of two or more short, straight divisions instead of a single rectilinear path according to the prior art.

In the representative embodiments of the invention to be disclosed subsequently, two or four ink jet heads are provided by the side of each straight part of the guide path for printing on the strip traveling along that part. However, only one head may be provided for each division of the path if it is desired to make each path division sufficiently short to preclude any likelihood of the strip slacking, wrinkling, or otherwise going out of shape, particularly as in the case of a printer for use with an aqueous ink.

How many intermediate guide rollers should be employed, that is, how many straight parts the guide path should be divided into, depends at least in part upon how many ink jet heads the printer has. It is among the advantages of this invention that in printers having very large numbers of ink jet heads, correspondingly large numbers of intermediate guide rollers may be employed according to the principles of the invention without substantially adding to the manufacturing costs of the printers.

The above and other objects, features and advantages of this invention and the manner of achieving them will become more apparent, and the invention itself will best be understood, from a study of the following description and attached claims, with reference had to the accompanying drawings showing some preferable embodiments of the invention.

DESCRIPTION OF THE PREFERRED EMBODIMENTS

Figure 1:
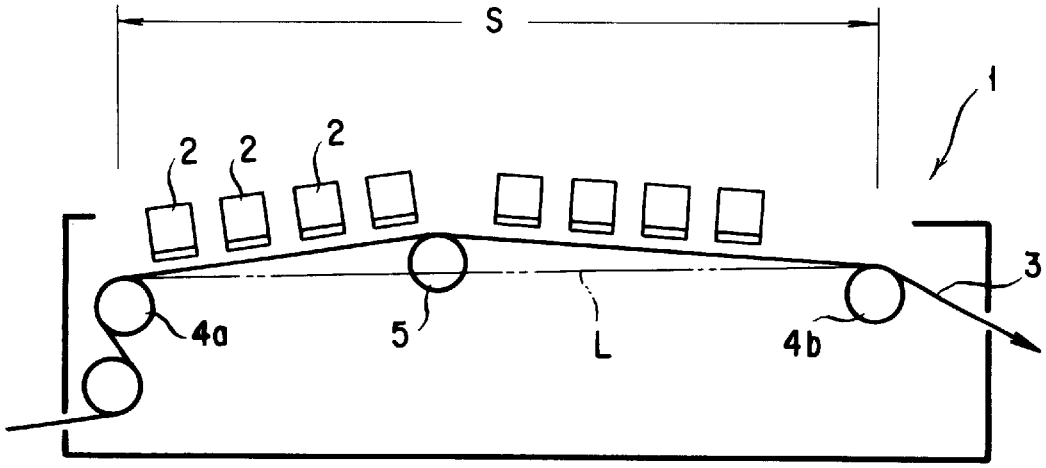
FIG. 1 is a diagrammatic illustration of some essential parts of a preferred form of ink jet printer constructed according to the principles of this invention.

The ink jet printer illustrated in FIG. 1 and therein generally labeled 1 has a plurality or multiplicity, eight for example, of ink jet heads 2 for printing as many characters or symbols on a continuous strip, ribbon, or web 3 of paper or other printable material as same travels along a predefined path taught by the instant invention. The printer 1 has a printing station S, where the ink jet heads 2 lie, through which the strip 3 is conventionally guided by and between an entrance guide roller 4*a* and an exit guide roller 4*b*. Despite its naming, the exit guide roller 4*b* may serve also to feed the strip 3 through the printing station S by being coupled to a drive means, not shown, customarily incorporated in ink jet printers of this kind.

Further, according to the novel concepts of this invention, a between guide roller 5 is provided intermediate the two guide rollers 4*a* and 4*b* for rotation about an axis parallel to the axes of rotation of these guide rollers wherein the area between the guide roller 4*a* and the intermediate guide roller 5 is a first print area and the area between the intermediate guide roller 5 and the guide roller 4*b* is a second print area. The intermediate guide roller 5 is not aligned with the guide rollers 4*a* and 4*b* but so positioned as to create an obtuse-angled bend in the guide path for the strip 3. More specifically, toward that end, the intermediate guide roller 5 is offset from a plane L tangent to both guide rollers 4*a* and 4*b* toward that side of the plane which is opposite to the side where the guide rollers lie.

Thus, contacting the surface of the intermediate guide roller 5 through a certain angle, the strip 3 travels along the obtuse-angled guide path through the printing station S, although the guide path could be acute-angled as permitted by the printer design. The intermediate guide roller 5 may be considered to divide the guide path between the guide rollers 4*a* and 4*b* into two straight halves.

The eight ink jet heads 2 are also divided into two groups, each consisting of four heads, with one group aligned alongside the guide path section between entrance guide roller 4*a* and intermediate guide roller 5, and the other group aligned alongside the other guide path section between intermediate guide roller 5 and exit guide roller 4*b*, All these ink jet heads 2 are disposed on that side of the guide path of the strip 3 which is opposite to the side where the guide and intermediate guide rollers lie. It is understood that as has been known heretofore, the ink jet heads 2 are each so independently supported as to permit fine positional and postural adjustments with respect to the strip 3, so that they may all be held at a predetermined constant spacing from the strip.

The distance between the guide rollers 4*a* and 4*b* may increase with greater numbers of ink jet heads 2 in use. In this embodiment of the invention, however, that distance is readily divisible into two halves. The strip 3 is therefore to flutter less, and suffer less adverse effects of use of an aqueous ink, during its travel through each half distance between the guide rollers 4*a* and 4*b*, As required or desired, the path of the strip 3 between the guide rollers 4*a* and 4*b* may be divided into more sections than two, in order to make each such section shorter or to accommodate greater numbers of ink jet heads. Thus in FIG. 2, which shows another preferred form of ink jet printer 1*a*, three intermediate guide rollers 5 and 5' are shown provided between the guide rollers 4*a* and 4*b*, The two intermediate guide rollers 5 are spaced from each other and offset from the plane L tangent to both guide rollers 4*a* and 4*b* to the approximately same extent toward that side of the plane opposite to the side where the guide rollers are. Disposed intermediate the first recited two intermediate guide rollers 5, the other intermediate guide roller 5' is offset from the plane L toward the same side as the rollers 5 are, to a greater extent than these rollers.

As the path of the strip 3 between the guide rollers 4*a* and 4*b* is divided into four straight sections of approximately the same distance in this ink jet printer 1*a*, so are the eight ink jet heads 2 equally divided into four groups disposed one alongside each section of the path for printing on the strip 3 traveling along the same. All the ink jet heads 2 lie on that side of the strip path which is opposite to the side where the guide and intermediate guide rollers are.

With the path between the guide rollers 4*a* and 4*b* divided into more sections in this printer la than in the FIG. 1 printer 1, each section can be made shorter. Traveling along a series of such short sections, the strip 3 will be less liable to flutter or otherwise go out of shape.

Figure 2:
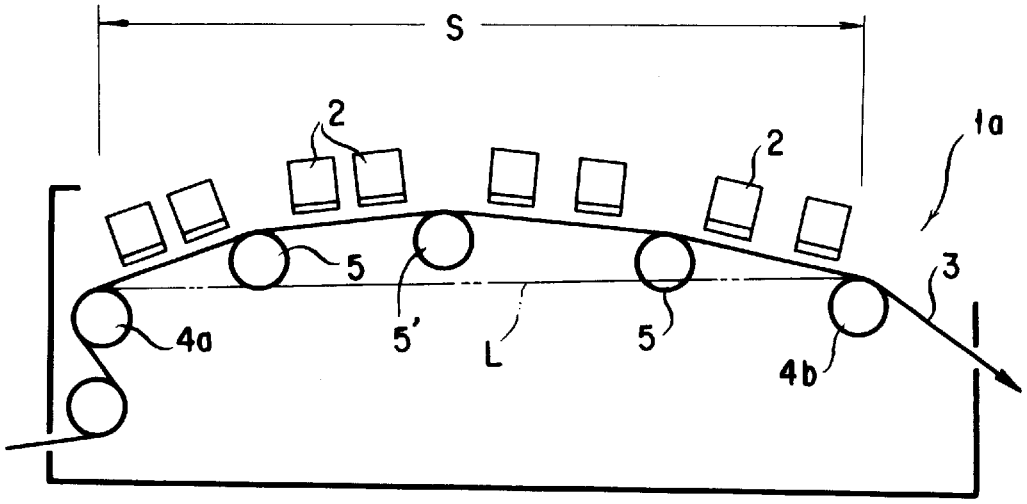
FIG. 2 is a similar illustration of another preferred form of ink jet printer according to the invention.
Figure 3:
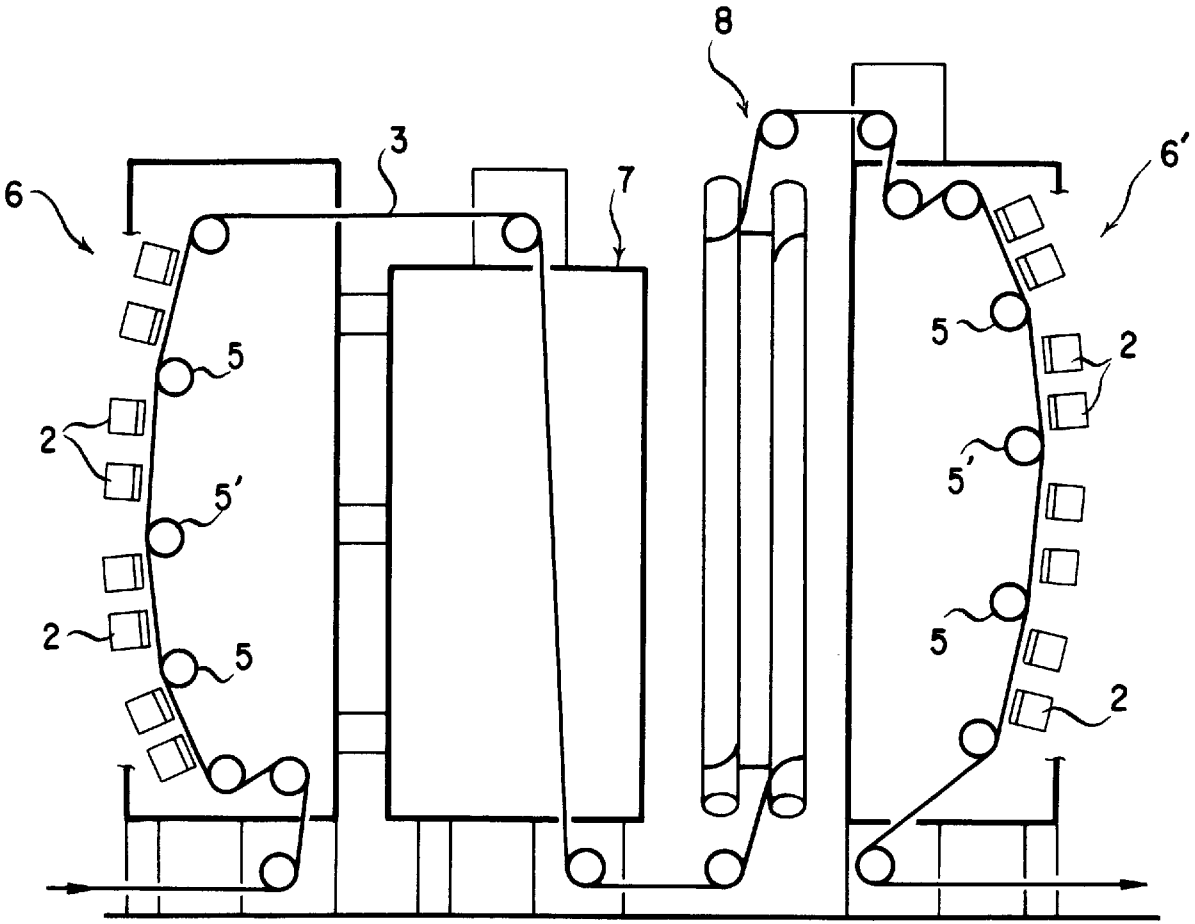
FIG. 3 a similar illustration of still another preferred form of ink jet printer according to the invention.

The principles of this invention are applicable to ink jet printers designed to print on both sides of a strip. FIG. 3 illustrates an example of such double side ink jet printer. Generally designated 1*b*, the printer has two printing stations 6 and 6' which are each shown to be of the same construction as the FIG. 2 printer 1*a*. The strip 3 is printed on one side thereof at the first printing station 6, dried at a drying station 7, reversed at a turnover station 8, and then printed on the other side thereof at the second printing station 6'.

Since the two printing stations 6 and 6' of this printer 1*b* are of the same construction as the FIG. 2 printer 1*a*, it is apparent that they gain the same advantages as set forth with reference to FIG. 2.

Although the present invention has been hereinbefore described very specifically and as adapted for an ink jet printer, it is not desired that the invention be limited by the exact details of this disclosure. A variety of modifications and alterations of the illustrated embodiments may be made in order to conform to design preferences or to the requirements of each specific application, without departing from the proper scope or fair meaning of the claims which follow.

What is claimed is:

1. A multiple-head ink jet printer for printing on a continuous strip of printable material, said multiple-head ink jet printer comprising:

first and second guides spaced from each other operable to guide the continuous strip of printable material;

at least one intermediate guide member disposed in between said first and second guides providing a guide path having a bend for the continuous strip of printable material between said first and second guides, wherein an area between said first guide and said at least one intermediate guide member is a first print area and an area between said at least one intermediate guide member and said second guide is a second print area; and at least one ink jet head operable to print on the continuous strip of printable material located in each of said first and second print areas, wherein at least one of said first and second print areas has a plurality of ink jet heads located therein.

2. A multiple-head ink jet printer for printing on a continuous strip of printable material, said multiple-head ink jet printer comprising:

first and second guide rollers spaced from each other and rotatable about axes that are parallel to each other, said first and second guide rollers operable to guide the continuous strip of printable material;

at least one intermediate guide roller disposed in between said first and second guide rollers and offset from a plane tangent to both said first and second guide rollers, said at least one intermediate guide roller providing a guide path having a bend for the continuous strip of printable material, wherein an area between said first guide roller and said at least one intermediate guide roller is a first print area and an area between said at least one intermediate guide roller and said second guide roller is a second print area; and at least one ink jet head operable to print on the continuous strip of printable material located in each of said first and second print areas, wherein at least one of said first and second print areas has a plurality of ink jet heads located therein.

3. A multiple-head ink jet printer for printing on a continuous strip of printable material, said multiple-head ink jet printer comprising:

first and second guide rollers spaced from each other and rotatable about axes that are parallel to each other, said first and second guide rollers operable to guide the continuous strip of printable material;

at least one intermediate guide roller disposed in between and out of alignment with said first and second guide rollers and rotatable about an axis that is parallel to axes of rotation of said first and second guide rollers, said at least one intermediate guide roller operable to take up any slack of the continuous strip of printable material;

a first row of ink jet heads positioned between said first guide roller and said at least one intermediate guide roller operable to print on the continuous strip of printable material; and a second row of ink jet heads positioned between said at least one intermediate guide roller and said second guide roller operable to print on the continuous strip of printable material.

4. A multiple-head ink jet printer for printing on a continuous strip of printable material, said multiple-head ink jet printer comprising:

first and second guide rollers spaced from each other and rotatable about axes that are parallel to each other, said first and second guide rollers operable to guide the continuous strip of printable material;

at least one intermediate guide roller disposed in between said first and second guide rollers and offset from a plane tangent to both said first and second guide rollers toward one side of the plane opposite to a side where said first and second guide rollers lie, said at least one intermediate guide roller being rotatable about an axis that is parallel to the axes of rotation of said first and second guide rollers and operable to guide the continuous strip of printable material, wherein an area between said first guide roller and said at least one intermediate guide roller is a first print area and an area between said at least one intermediate guide roller and said second guide roller is a second print area; and at least one ink jet head operable to print on the continuous strip of printable material located in each of said first and second print areas, wherein at least one of said first and second print areas has a plurality of ink jet heads located therein.

5. A multiple-head ink jet printer as recited in claim 4, wherein all of said ink jet heads are positioned on the one side of the plane tangent to both said first and second guide rollers.

6. A multiple-head ink jet printer as recited in claim 5, wherein both of said first and second print areas have a plurality of ink jet heads located therein.

7. A multiple-head ink jet printer for printing on a continuous strip of printable material, said multiple-head ink jet printer comprising:

first and second guide rollers spaced from each other and rotatable about axes that are parallel to each other, said first and second guide rollers operable to guide the continuous strip of printable material;

first and second intermediate guide rollers disposed in between said first and second guide rollers and offset from a plane tangent to both said first and second guide rollers toward one side of the plane opposite to a side where said first and second guide rollers lie, said first and second intermediate guide rollers being rotatable about an axis that is parallel to the axes of rotation of said first and second guide rollers and operable to guide the continuous strip of printable material;

at least one additional intermediate guide roller disposed in between said first and second intermediate guide rollers and offset from the plane toward the one side to a greater extent than said first and second intermediate guide rollers, said at least one additional intermediate guide roller being rotatable about an axis that is parallel to the axes of rotation of said first and second guide rollers, wherein an area between said first guide roller and said first intermediate guide roller is a first print area, an area between said first intermediate guide roller and said at least one additional intermediate guide roller is a second print area, an area between said at least one additional intermediate guide roller and said second intermediate guide roller is a third print area and an area between said second intermediate guide roller and said second guide roller is a fourth print area; and at least one ink jet head operable to print on the continuous strip of printable material located in each of said first, second, third and fourth print areas, wherein at least one of said first, second, third and fourth print areas has a plurality of ink jet heads located therein.

8. A multiple-head ink jet printer as recited in claim 7, wherein all of said ink jet heads are positioned on the one side of the plane tangent to both said first and second guide rollers.

9. A multiple-head ink jet printer as recited in claim 8, wherein all of said first, second, third and fourth print areas have a plurality of ink jet heads operable to print on the continuous strip of printable material located therein.

10. A multiple-head ink jet printer for printing on a continuous strip of printable material, said multiple-head ink jet printer comprising:

first and second guide rollers spaced from each other and rotatable about axes that are parallel to each other, said first and second guide rollers being operable to guide the continuous strip of printable material;

first and second intermediate guide rollers disposed in between said first and second guide rollers and offset from a plane tangent to both said first and second guide rollers toward one side of the plane opposite to a side where said first and second guide rollers lie, said first and second intermediate guide rollers being rotatable about an axis that is parallel to the axes of rotation of said first and second guide rollers and operable to guide the continuous strip of printable material, wherein an area between said first guide roller and said first intermediate guide roller is a first print area, an area between said first intermediate guide roller and said second intermediate guide roller is a second print area and an area between said second intermediate guide roller and said second guide roller is a third print area; and at least one ink jet head operable to print on the continuous strip of printable material located in each of said first, second, and third print areas, wherein at least one of said first, second and third print areas has a plurality of ink jet heads located therein.

11. A multiple-head ink jet printer as recited in claim 10, wherein all of said ink jet heads are positioned on the one side of the plane tangent to both said first and second guide rollers.

12. A multiple-head ink jet printer as recited in claim 11, wherein all of said first, second, and third print areas have a plurality of ink jet heads operable to print on the continuous strip of printable material located therein.

* * * * *